US006783329B2

(12) United States Patent
Vilela et al.

(10) Patent No.: US 6,783,329 B2
(45) Date of Patent: Aug. 31, 2004

(54) REGULATING JET PUMP WITH TWO FLUID SEALS, ONE OPENING AT AN INTERMEDIATE INLET PRESSURE AND THE OTHER OPENING AT A HIGHER INLET PRESSURE FOR INCREASED FLOW THROUGH THE PUMP

(75) Inventors: Frédérico Vilela, Chalons en Champagne (FR); Laurent Aubree, La Ville Aux Bois, Les Pontave (FR)

(73) Assignee: Marwal Systems, Charlons en Champagne (FR)

( * ) Notice: Subject to any disclaimer, the term of this patent is extended or adjusted under 35 U.S.C. 154(b) by 59 days.

(21) Appl. No.: 10/323,898

(22) Filed: Dec. 20, 2002

(65) Prior Publication Data

US 2003/0118455 A1 Jun. 26, 2003

(30) Foreign Application Priority Data

Dec. 21, 2001 (FR) ..... 01 16715

(51) Int. Cl.[7] ..... F04F 5/48

(52) U.S. Cl. ..... 417/189; 417/168; 417/169; 417/183; 417/184; 137/895; 137/110

(58) Field of Search ..... 417/189, 168, 417/169, 170, 182, 183, 184, 187; 137/892, 601.2, 115.13, 115.28, 895, 110

(56) References Cited

U.S. PATENT DOCUMENTS 1,133,601 A * 3/1915 Wood ..... 417/183
2,674,202 A * 4/1954 Kelley et al. ..... 417/172
4,176,686 A * 12/1979 Stahle ..... 137/892
4,310,288 A * 1/1982 Erickson ..... 417/54
5,148,830 A * 9/1992 Liu ..... 137/513.7
5,427,151 A * 6/1995 Pauley ..... 137/895
5,474,104 A * 12/1995 Borland et al. ..... 137/381
5,507,436 A * 4/1996 Ruttenberg ..... 239/1
5,538,027 A * 7/1996 Adamson et al. ..... 137/7
6,098,662 A * 8/2000 Gregoire ..... 137/891
6,364,625 B1 * 4/2002 Sertier ..... 417/182
6,634,376 B2 * 10/2003 Haas ..... 137/143

FOREIGN PATENT DOCUMENTS

| | | |
|---|---|---|
| DE | 26 02 234 | 4/1977 |
| DE | 32 12 194 | 10/1982 |
| DE | 39 15 185 | 10/1990 |

* cited by examiner

*Primary Examiner*—Justine R. Yu
*Assistant Examiner*—Emmanuel Sayoc
(74) *Attorney, Agent, or Firm*—Foley & Lardner LLP

(57) ABSTRACT

The invention provides a jet pump comprising a housing containing a nozzle into which an injected fluid is introduced, the housing also possessing a suction orifice, the pump comprising, upstream from the outlet of the nozzle, an auxiliary chamber associated with two sealing elements, each sealing element being adapted to open when the pressure of the injected fluid exceeds a predetermined level, the first sealing element opening at a first pressure level, the second sealing element opening at a second pressure level greater than or equal to the first.

13 Claims, 8 Drawing Sheets

REGULATING JET PUMP WITH TWO FLUID SEALS, ONE OPENING AT AN INTERMEDIATE INLET PRESSURE AND THE OTHER OPENING AT A HIGHER INLET PRESSURE FOR INCREASED FLOW THROUGH THE PUMP

GENERAL TECHNICAL FIELD

The present invention relates to the field of jet pumps.

The present invention finds particular but non-exclusive application in the field of motor vehicle fuel tanks.

Still more precisely, the present invention finds application in transferring fuel between different compartments in multi-compartment fuel tanks, or in filling a reserve bowl from which a fuel pump or any fuel feeder device draws fuel.

STATE OF THE ART

Examples of fuel suction devices based on jet pumps are shown in documents DE-A-3 915 185, DE-A-3 612 194, or DE-A-2 602 234.

Although known suction devices based on jet pumps have given good service, they nevertheless do not always give satisfaction.

An object of the present invention is to propose a novel and improved jet pump.

SUMMARY OF THE INVENTION

The invention seeks to mitigate those drawbacks.

To this end, the invention provides a jet pump comprising a housing containing a nozzle into which an injected fluid is introduced, the housing also possessing a suction orifice, the pump comprising, upstream from the outlet of the nozzle, an auxiliary chamber associated with two sealing elements, each sealing element being adapted to open when the pressure of the injected fluid exceeds a predetermined level, the first sealing element opening at a first pressure level, the second sealing element opening at a second pressure level greater than or equal to the first.

The invention advantageously further comprises the following characteristics taken singly or in any technical feasible combination:

- the first sealing element is situated upstream from the auxiliary chamber, the second sealing element being situated downstream from the auxiliary chamber;
- the first sealing element is situated upstream from the auxiliary chamber, the second sealing element being also situated upstream from the auxiliary chamber;
- the nozzle is slidably mounted in the pump housing, to move along a longitudinal axis of the pump housing against bias from a spring urging it against a sealing element;
- the first sealing element opens by means of the nozzle moving, the second sealing element being opened by limiting the displacement of a second moving element;
- both sealing elements are opened by displacement of the nozzle;
- the body of the nozzle comprises three portions: a central first portion generally in the form of a hollow circularly cylindrical tube of constant section; a second portion integrally molded on the outside surface of the central portion from the upstream end thereof and forming a drum extending towards the downstream end of the pump housing over the outside of the central portion; and a third portion situated downstream from the central portion having an outside shape that is substantially frustoconical and that converges downstream, its inside shape forming a nozzle outlet formed by a through axial channel connected to the inside volume of the central portion and opening out into a downstream suction chamber;
- the space defined between the drum and the central portion forms a chamber open towards the downstream end of the pump and receiving the bias spring;
- the general outside shape of the body of the nozzle in longitudinal section is substantially W-shaped, the two upstream bends of the W-shape forming a flat bottom defining a surface of generally annular shape lying in a transverse plane, facing upstream, and located inside the housing of the pump;
- the annular surface has a longitudinal peripheral rim on its outer periphery extending towards the upstream end of the pump, said rim co-operating with a transverse gasket fixed to the housing of the pump and situated facing the annular surface to define a first sealing element;
- the pump has a finger extending inside the inside volume of the central portion of the nozzle body, a cap movable in translation co-operating with a second bias spring which presses said cap against a transverse shoulder facing towards the upstream end of the pump and formed inside said central portion of the nozzle body, thus forming a second sealing element, which second sealing element is opened when the moving element reaches the end of its stroke as it follows the displacement of the nozzle body inside the pump housing, said displacement of the nozzle being due to the pressure of the injected fluid acting on the annular surface exceeding a second pressure level;
- the central portion and the downstream portion of the nozzle both have the same inside diameter, the inside opening as defined in this way being extended at the upstream end of the nozzle by a circular longitudinally-extending rim integrally molded on the annular surface, said circular rim co-operating with a deformable gasket fixed on an element of the pump so as to form a sealing element, said sealing element opening as the nozzle moves forwards, said forward movement taking place when the pressure of the injected fluid reaches a second level; and
- the inside shape of the third portion comprises, in the flow direction of the injected fluid, a first segment of converging frustoconical shape followed by a through second segment of circularly cylindrical shape of constant section.

BRIEF DESCRIPTION OF THE DRAWINGS

Other characteristics, objects, and advantages of the invention appear from the following description which is purely illustrative and non-limiting and which should be read with reference to the accompanying drawings, in which.

DETAILED DESCRIPTION

None of the jet pump embodiments described below has any element downstream from a nozzle. This avoids disturbing the flow of fluid downstream from the nozzle.

Description of a First Embodiment

Figure 1:
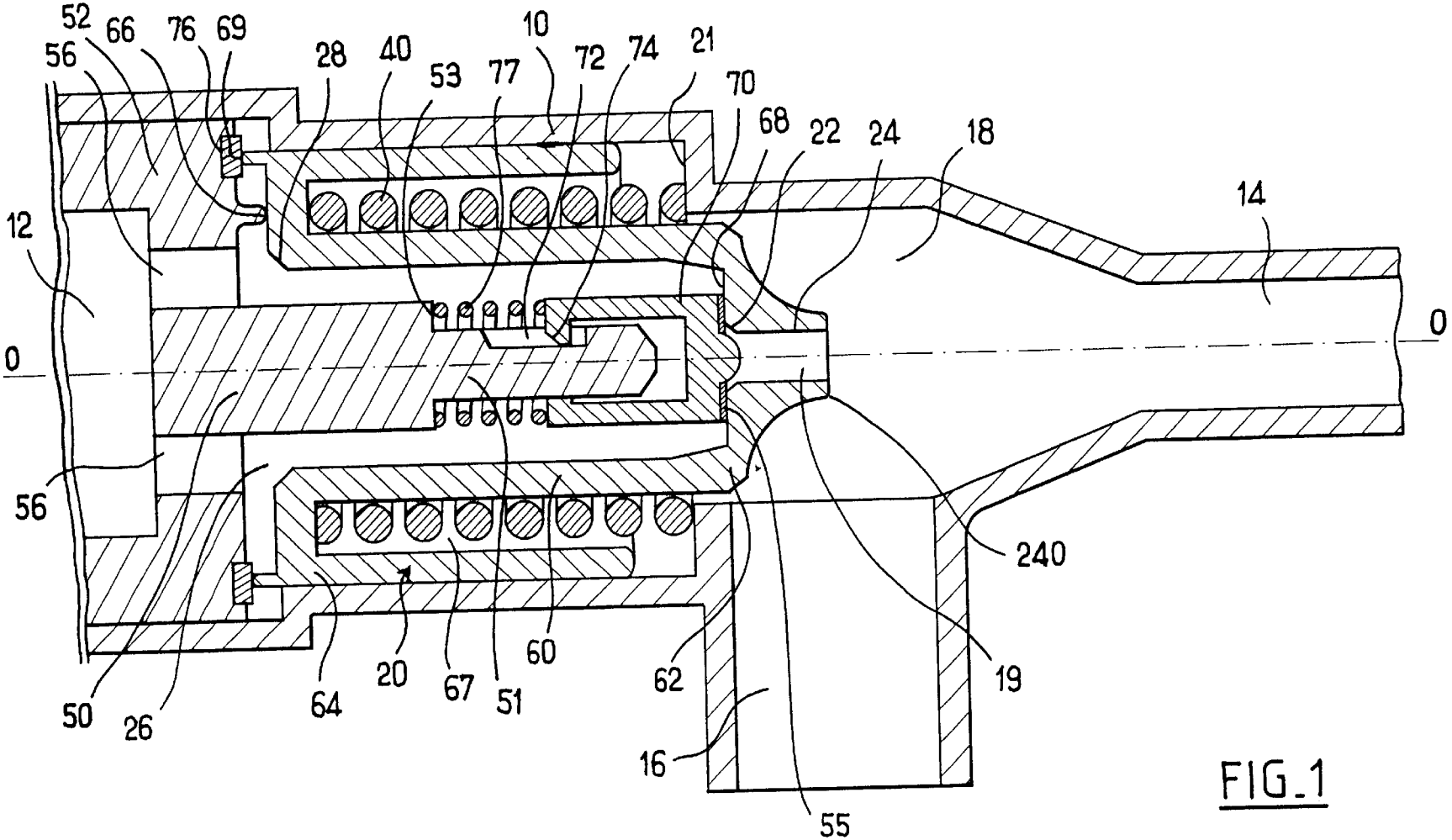
FIG. 1 is a longitudinal section view of an embodiment having two sealing elements.

FIG. 1 shows a jet pump in accordance with the present invention comprising a substantially circularly cylindrical housing 10 centered on a longitudinal axis O—O.

The housing 10 defines a control inlet 12 receiving the injected flow at a first axial end. The control chamber extends inside a body 52 that is itself substantially circularly cylindrical in shape.

The axial outlet 14 from the pump is defined at the opposite axial end.

The housing 10 also has an auxiliary suction inlet 16 which communicates laterally with the channel 18 inside the housing 10.

This internal channel 18 thus constitutes a suction chamber.

The axial outlet 14 into which the channel 18 opens out receives the flow injected via the inlet 12 plus the flow sucked in via the suction inlet 16.

The auxiliary suction inlet 16 is disposed upstream from a nozzle fed with the flow injected via the inlet 12. The suction inlet may be constituted by a short tube inclined relative to the axis O—O of the housing 10, e.g. at an angle lying in the range 10° to 90°. In the embodiment shown in FIG. 1, this angle is equal to 90°.

Similarly, the inlet 12 may be inclined relative to the axis O—O, typically at an angle lying in the range 0° to 90°. In FIG. 1, the inlet 12 lies on the axis O—O.

The body 20 of the nozzle is situated substantially in the middle of the housing 10. This body 20 is mounted to slide inside the inside diameter of the housing 10.

The moving body 20 has an inside volume constituting a portion of an auxiliary chamber 26.

At the upstream end of the body 20, the auxiliary chamber 26 communicates with the inlet chamber 12, and at the downstream end it communicates with the chamber 18 downstream from the nozzle. Communication between the upstream portion of the auxiliary chamber 26 and the suction chamber 18 take place via a nozzle outlet 19.

The sliding movement of the body 20 in the housing 10 takes place against bias from spring-forming means. It enables two sealing elements located upstream and/or downstream of the auxiliary chamber 26 to be opened or closed as a function of the pressure level of the injected fluid. Depending on the open or closed state of the sealing elements, the fluid flows either via the auxiliary chamber 26 and the nozzle outlet 19 towards the pump outlet 14, or else it flows round the outside edges of the nozzle.

A first sealing element situated on the outside portion of the nozzle, when closed, seals the nozzle against fluid leaking along the walls between the housing 10 and the body 20.

A second sealing element situated inside the inner portion of the nozzle, when in the closed position, serves to prevent any fluid leaking via the inside channel formed by the inside volume of the nozzle. The second sealing element also prevents a self-regulation process from applying to the pressure of the injected fluid. In the open position, self-regulation can take place as a function of the extent to which the sealing element is open.

The first sealing element opens at a first predetermined pressure level, the second sealing element opens at a second predetermined pressure level, said second pressure level being greater than or equal to the first predetermined pressure level.

Figure 9:
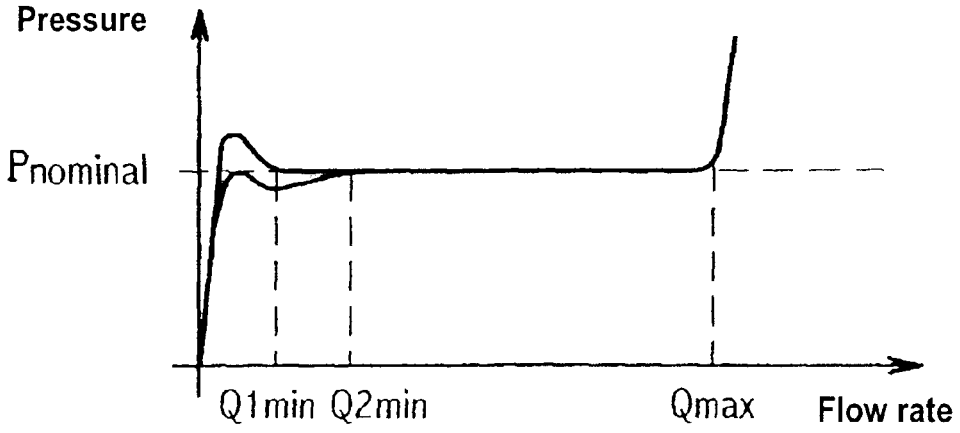
FIG. 9 is a graph showing how the pressure in the chamber varies as a function of injected flow rate when only one opening is provided in the nozzle device.

FIG. 9 is a graph showing how pressure varies inside the chamber as a function of variation in the injected flow rate, and it can be seen that when only one opening is provided in the nozzle, then there is a jump in the pressure inside the chamber.

Figure 10:
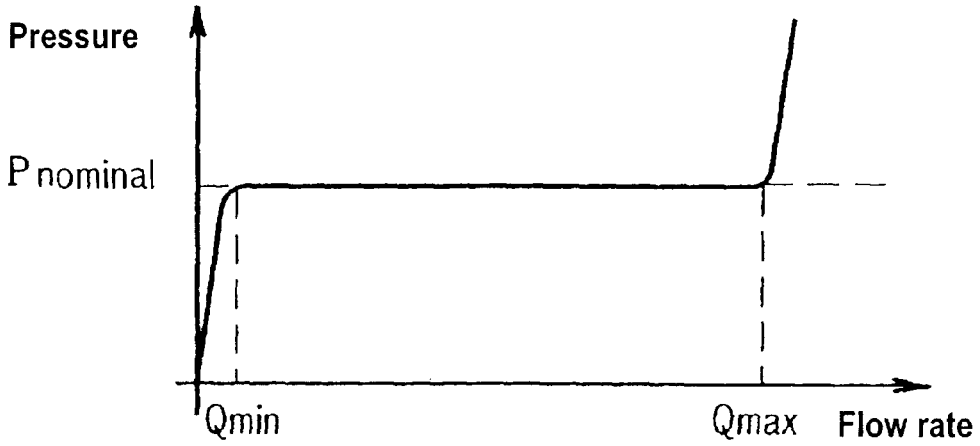
FIG. 10 is a graph showing how the pressure in the chamber varies as a function of the injected flow rate when there are two openings provided in the nozzle device.

However, FIG. 10 which is likewise a graph showing pressure as a function of flow rate, shows that the pressure remains substantially constant inside the chamber since the regulation function and the opening of the second sealing element compensates for the increase in the area of contact with the pressure fluid.

To this end, the sealing elements may be constituted by two gaskets. These two gaskets may be distinct and they may present different structures and elastic deformation properties. It is thus possible to obtain two sealing elements which open at two different pressure levels when they co-operate with means that are integrally molded with the moving body 20 that is subjected to thrust from the single spring-forming means.

Also for this purpose, the two sealing elements may be formed in a washer presenting a single set of elastic deformation properties, but co-operating with means molded integrally with the moving body 20 and having different axial extents. These different axial extents cause the sealing elements to open at different pressure levels.

Still for this purpose, a first sealing element may be formed by a gasket having elastic deformation properties and co-operating with means molded integrally with the moving body 20, while a second sealing element is formed by at least one valve-forming element on the self-regulation nozzle and co-operating with other spring-forming means.

The moving body 20 comprises three portions:

- a central first portion 60 generally in the form of a circularly cylindrical tube of constant hollow section centered on the axis O—O;
- a second portion 64 integrally molded on the outside surface of the central portion 60 at the upstream end thereof, forming a drum extending towards the downstream end of the pump body 10, outside the central portion 60. The space defined between the barrel 64 and the central portion 60 forms a chamber 67 that is open towards the downstream end of the pump. This chamber 67 receives a bias spring 40; and
- a third portion 62 situated downstream from the central portion 60. The third portion 62 has an outline that is substantially frustoconical, converging downstream. The inside bore of the portion 62 forms the nozzle 19 constituting a through axial channel extending from the inside volume of the central portion 60 and opening out into the suction chamber 18.

The inside channel in the third portion 62 preferably converges downstream.

More precisely, in the embodiment shown in FIG. 1, the inside channel of the third portion 62 comprises two axially juxtaposed segments 22 and 24.

The first segment 22 which is upstream in the flow direction is preferably of a downwardly-converging frustoconical shape. The half-angle at the apex of this segment 22 preferably lies in the range 10° to 80°.

The second segment 24 of the body 20 is preferably circularly cylindrical and of constant section. The free outside end 240 of this segment 24 is slightly rounded.

The inside diameter of the segment 24 lies advantageously in the range 1 millimeter (mm) to 3.6 mm.

A shoulder 68 extending transversely to the axis O—O and facing upstream is formed between the inside profile of the central portion 60 and the channel of the third portion 62 of the body 20.

The general outside shape of the body 20 in longitudinal section is thus substantially W-shaped. The central point of the W-shape points towards the downstream end of the pump.

Still in longitudinal section, the two upstream bends of the W-shape form a flat bottom 66. This surface 66 thus defines, inside the pump body and in a transverse plane, a surface that is generally annular in shape and faces upstream. The space defined inside the annular surface 66 may include a central chamfer 28 of frustoconical shape converging downstream.

An auxiliary chamber 26 is formed between the control chamber 12 and the outlet from the nozzle. The auxiliary chamber 26 is constituted by the inside volume of the housing 10 upstream from the moving body 20 of the nozzle, and by the inside volume of the moving body.

At least one orifice 56 through the body 52 enables fluid to pass from the control chamber 12 to the auxiliary chamber 26.

The body 20 is mounted to slide in the body of the housing 10 along the axis O—O. The outside shape of the drum 64 has an outside diameter that is substantially equal to the inside diameter of the housing 10. Complementary longitudinal fluting between the housing 10 and the body 20 allows one to slide relative to the other (possibly preventing rotation).

Fluid can thus leak between the outside of the drum 64 and the inside of the housing 10.

Such leakage is undesirable in a rest position. Thus, a first sealing element serves to make the nozzle proof against fluid leaks around the outside of its moving body 20.

However, this leakage phenomenon becomes desirable on going past a first pressure level.

This first sealing element is formed by co-operation between a first gasket and a rim molded integrally on the body 20.

For this purpose, a rim 69 integrally molded on the bend of the drum 64 is directed towards the upstream end of the pump, longitudinally along the axis O—O.

It co-operates with a fixed gasket 76 on the body 52, compressing the gasket due to the urging from the spring 40. The spring 40 placed between the elements 60 and 64 is positioned between the upstream portion of the body 20 and a step 21 in the housing 10. The spring 40 thus urges the body 20 upstream to press against the gasket 76.

A second sealing element must be capable of closing off the nozzle 19 in a rest position and continues to do so up to a second pressure level. This second sealing element must consequently be pressed against the nozzle outlet, even during movement of the moving body 20, and it must release the nozzle outlet 19 once the second pressure level has been reached. The sealing element must consequently be movable in translation so as to be capable of tracking movement of the moving body 20, but its own displacement must be limited.

For this purpose, a finger 50 extends inside the central portion 60. The finger 50 is integrally molded on the body 52 of the control chamber 12. It is substantially circularly cylindrical.

An extension 51 integrally molded with the finger 50 extends towards the downstream end of the pump inside the central portion 60. The extension 51 has a circularly cylindrical base of constant section adjacent to the finger 50. The outside diameter of the extension 51 is smaller than the outside diameter of the finger 50. A shoulder 53 facing towards the downstream end of the pump demonstrates this difference in diameter and serves as a bearing surface for means that bias the second sealing element.

The extension also has at least one groove 72 occupying at least one of its generator lines and serves as a guide for movement in translation of a moving element that forms the moving sealing element.

A moving cap 70 substantially in the form of a hollow circular cylinder is slidably mounted on the free end of the extension 51. The bore of the cap is blind at one end. The cap 70 has at least one spur 74 integrally molded with the open end of the cap and engaged in the groove 72 of the extension 51. Each spur 74 is a guide for movement in translation and also serves as an abutment in the groove 72 so as to restrict the axial displacement of the moving cap 70.

The blind plane end 55 of the cap 70 extends across the axis O—O. The surface 55 may advantageously carry a finger for centering in the nozzle outlet 19.

The ratio between the outside diameter of the moving cap 70 and the inside diameter of the housing 10 is advantageously less than 0.5.

A second bias spring 77 is situated between the rim of the cap 70 and the shoulder 53 that extends transversely to the axis O—O between the finger 50 and the extension 51.

The spring 77 urges the cap 70 downstream against the shoulder 68.

Where appropriate, one of the two surfaces 55 and 68 may be fitted for this purpose with a specific sealing lining, for example a lining based on elastomer.

Thus, in the embodiment shown in FIG. 1, the nozzle is formed by the combination of the moving body 20 mounted to move in translation and the assembly formed by the finger 50 and its extension 51 placed inside the moving body.

The spring 77 is stiffer than the spring 40.

The first sealing element is situated upstream of the auxiliary chamber 26, while the second sealing element is situated downstream of the auxiliary chamber 26.

The device operates essentially as follows.

FIG. 1 shows the rest position of the device, i.e. a situation in which fluid is injected into the auxiliary chamber 26 at low pressure. At rest, when the pressure of the injected fluid is relatively low, the bias force of the spring 40 presses the rim 69 against the gasket 76, thus forming the first sealing element. The bias force of the spring 77 presses the downstream surface 55 of the cap 70 against the step 68, thus forming the second sealing element.

It is assumed that the pressure of the injected fluid rises.

The injected fluid will reach a pressure such that the product of that pressure multiplied by the area of the surface 66 becomes greater than the rated force delivered by the spring 40. The moving body 20 will thus be moved in translation towards the downstream end of the pump, thereby opening the first sealing element.

Figure 2:
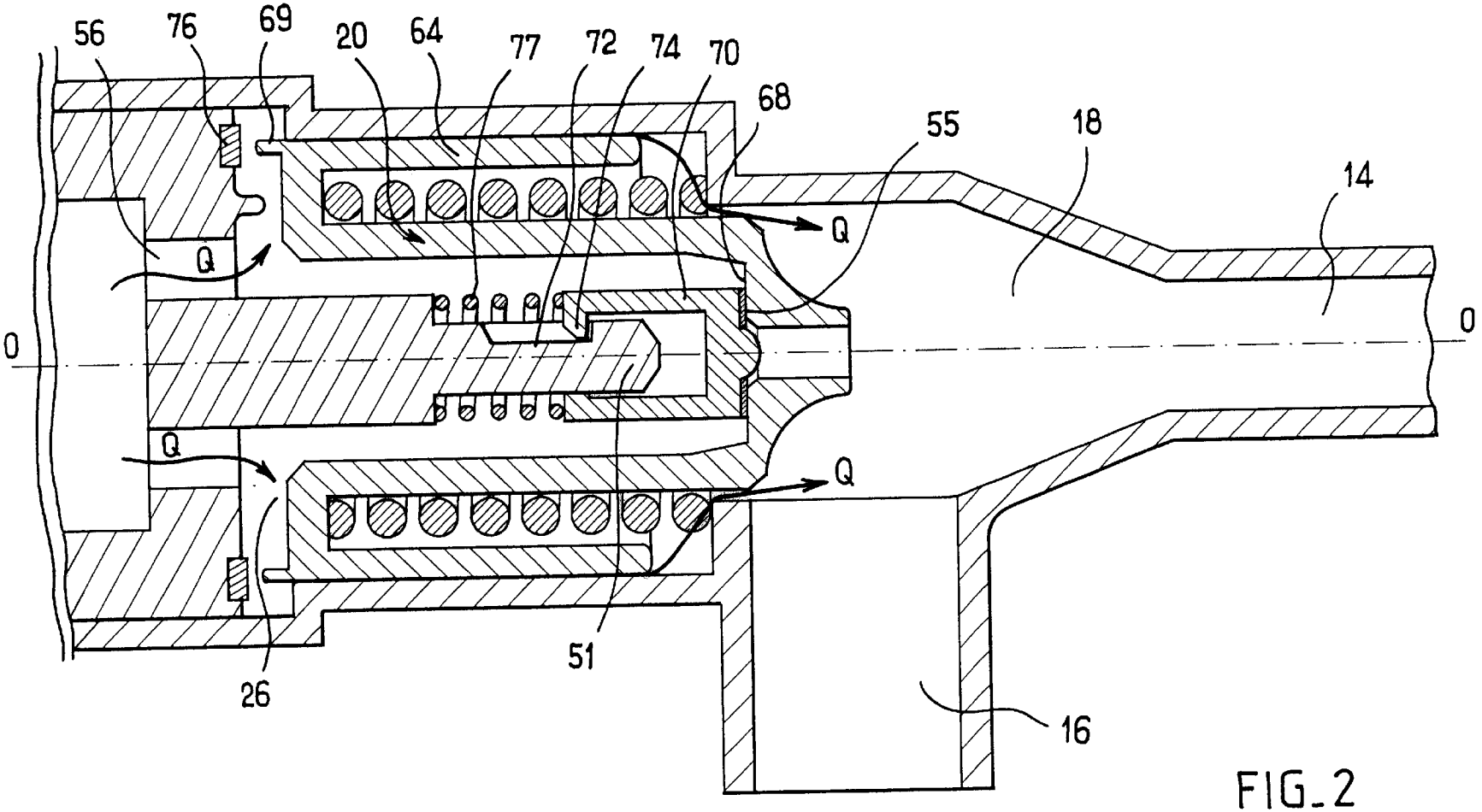
FIG. 2 is a view of the FIG. 1 device with the first sealing element in the open position.

In FIG. 2, the first pressure level has been exceeded in the auxiliary chamber 26 relative to the situation shown in FIG. 1. The fluid flows along the inside wall of the housing 10 and along the outside wall of the barrel 64. The path followed by the fluid is represented by arrows Q in FIG. 2. Nevertheless, the quantity of fluid following this path is relatively small. It does not suck liquid into the auxiliary inlet 16.

As the pressure of the fluid in the auxiliary chamber 26 continues to increase, the body 20 moves axially towards the suction chamber 18. Nevertheless, the bias spring 77 continues to press the moving element 70 against the shoulder 68 and causes the element 70 to move together with and in leaktight manner against the body 20. The second sealing element remains closed.

However, a second pressure level will eventually be reached, such that the moving body 20 has moved towards the suction chamber 18 by a distance greater than the stroke available in the grooves 72 for the moving body.

This second pressure level is greater than or equal to the first pressure level. When the second sealing element opens, the fluid engages other surfaces which compensate for the areas that were under pressure prior to said second sealing element opening, particularly inside the structure of the nozzle.

Each spur 74 reaches the end of its stroke in the corresponding groove 72 formed in the element 51.

The cap 70 can therefore no longer follow the body 20 in its displacement towards the suction chamber 18. As the pressure continues to rise, so that the body 20 continues to move axially, the second sealing element opens. This is a situation shown in FIG. 3.

It should be observed that it is advantageous for the total stroke of each spur 74 in the corresponding groove 72 between the position in which both sealing elements are closed and the position in which both sealing elements are open lies in the range 0.1 mm to 4 mm.

The liquid can then flow through the space left empty between the face 55 of the element 70 and the shoulder 68. This flow of fluid is represented by arrows Qi in FIG. 3.

The flow Qi is greater than the flow Q shown in FIG. 2. Thus, fluid represented by arrow Qa can be sucked in and sent to the axial outlet 14. Arrow Qt represents the sum of the flows Qi plus Qa.

The self-regulation effect is obtained by the space 23 between the step 68 and the wall 55. The space 23 results from equilibrium between the bias force from the spring 40 and the pressure of the injected fluid acting on the surface 66 once the second sealing element has opened. The suction of fluid through the inlet 16 is thus regulated by the size of the space 23.

A hysteresis effect may be obtained by increasing the area on which the fluid pressure acts.

Before and after opening of the first sealing element, but before opening of the second sealing element, the pressure of the fluid acts on the surface 66.

Once the second sealing element opens, the fluid also applies pressure to the shoulder 68 of the inside shape of the nozzle.

Consequently, closure of the sealing element requires the pressure of the fluid to drop to a pressure lower than that needed for opening it.

Description of a Second Embodiment of a Pump with a Regulating Jet

Figure 3:
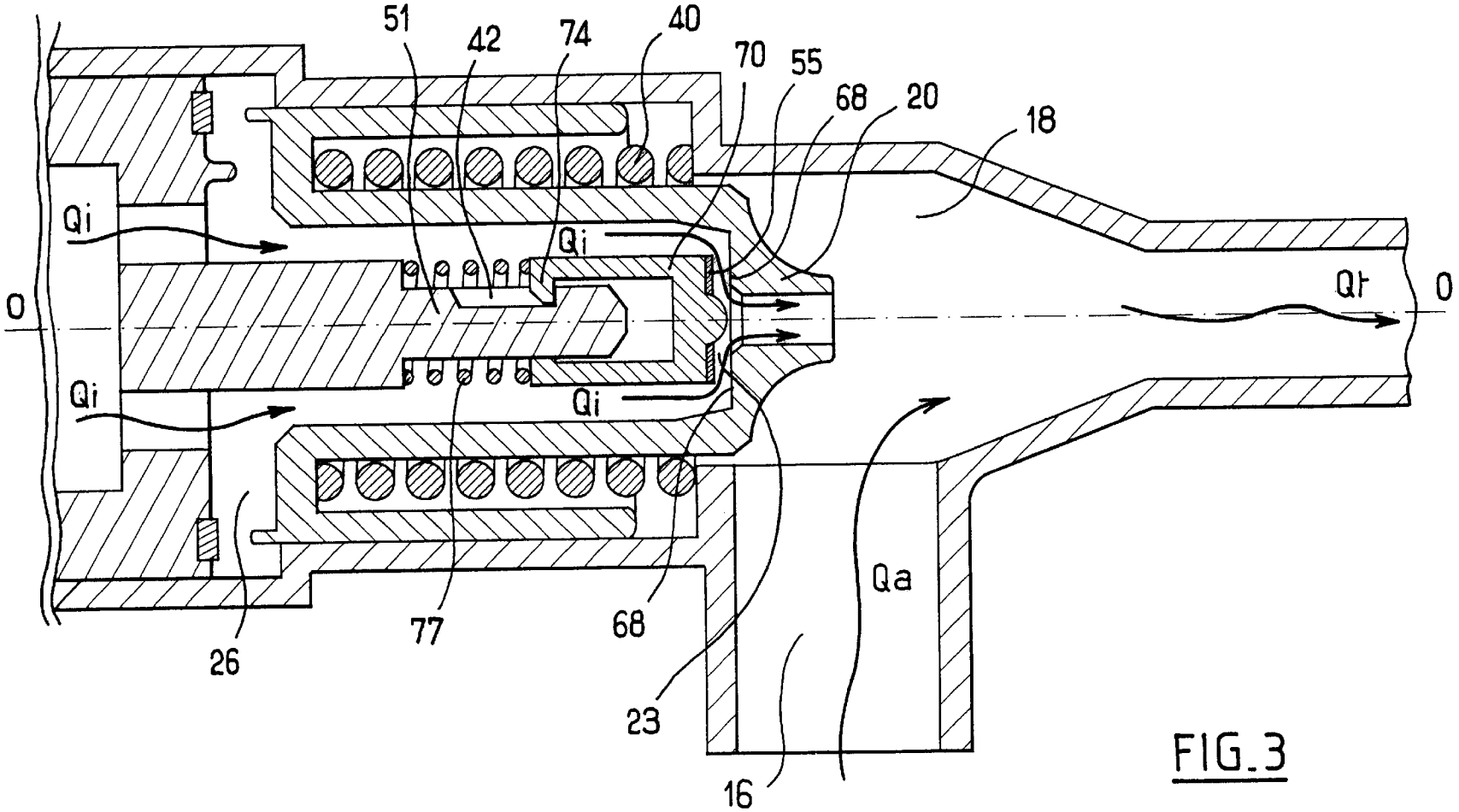
FIG. 3 is a view of the FIG. 1 device with the second sealing element in the open position.
Figure 4:
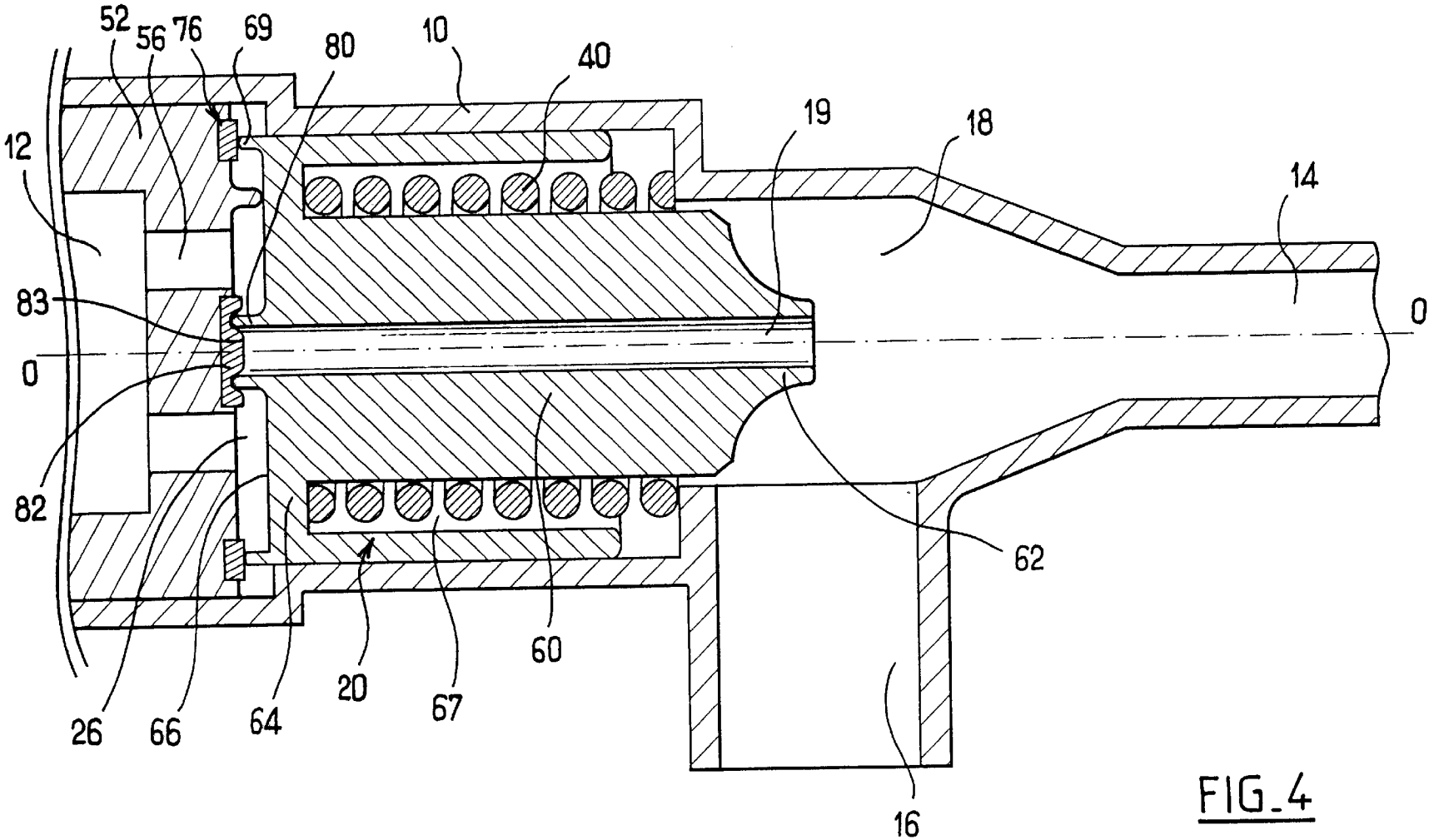
FIG. 4 is a longitudinal section view of another embodiment having two sealing elements.

The device shown in FIG. 4 possesses the same elements as the device shown in FIGS. 1 to 3 of the present application.

In this figure, and in the following figures, elements that are similar or have the same function as those shown in FIGS. 1 to 3 and that are described above are given the same numerical references.

The auxiliary chamber 26 extends between the control inlet 12 and the nozzle outlet 19, and consequently it extends in the inside volume of the moving body 20 of the nozzle.

The moving body 20 is generally substantially identical in shape to the nozzle body 20 shown in FIGS. 1 to 3.

However, the inside space of the central portion 60 is of constant section.

The first sealing element is still situated upstream from the auxiliary chamber 26 and is constituted by co-operation between a rim 69 and a gasket 76 fixed to the body 52, but in the embodiment of FIG. 4, the second sealing element is also situated upstream from the auxiliary chamber 26.

The second sealing element is situated on the axis O—O upstream from the upstream inlet 83 to the inside volume of the body 20.

A peripheral rim 80 at the inlet 83 extends towards the upstream end of the pump longitudinally along the axis O—O. It is integrally molded with the surface 66 around the inlet 83.

Because of the bias force of the spring 40 situated outside the moving body 20, the rim 80 co-operates with a transverse gasket 82 situated on the axis O—O. The gasket 82 is fixed on the body 52 of the control inlet 12.

The second sealing element needs to open when the pressure of the injected fluid is higher than the pressure needed for opening the first sealing element.

For this purpose, the axial extent of the rim 80 towards the upstream end of the pump is greater than the axial extent of the rim 69.

However, in a variant, it would be possible to use rims of identical axial extent but co-operating with gaskets, e.g. 76 and 82, having different elastic deformation properties, such that the seals open at different pressure levels.

This embodiment has the advantage of requiring only one bias spring.

The device operates as follows.

FIG. 4 shows the rest position. The fluid injected is at relatively low pressure and both sealing elements are closed. The pump is entirely leaktight.

Assume that the pressure increases.

Figure 5:
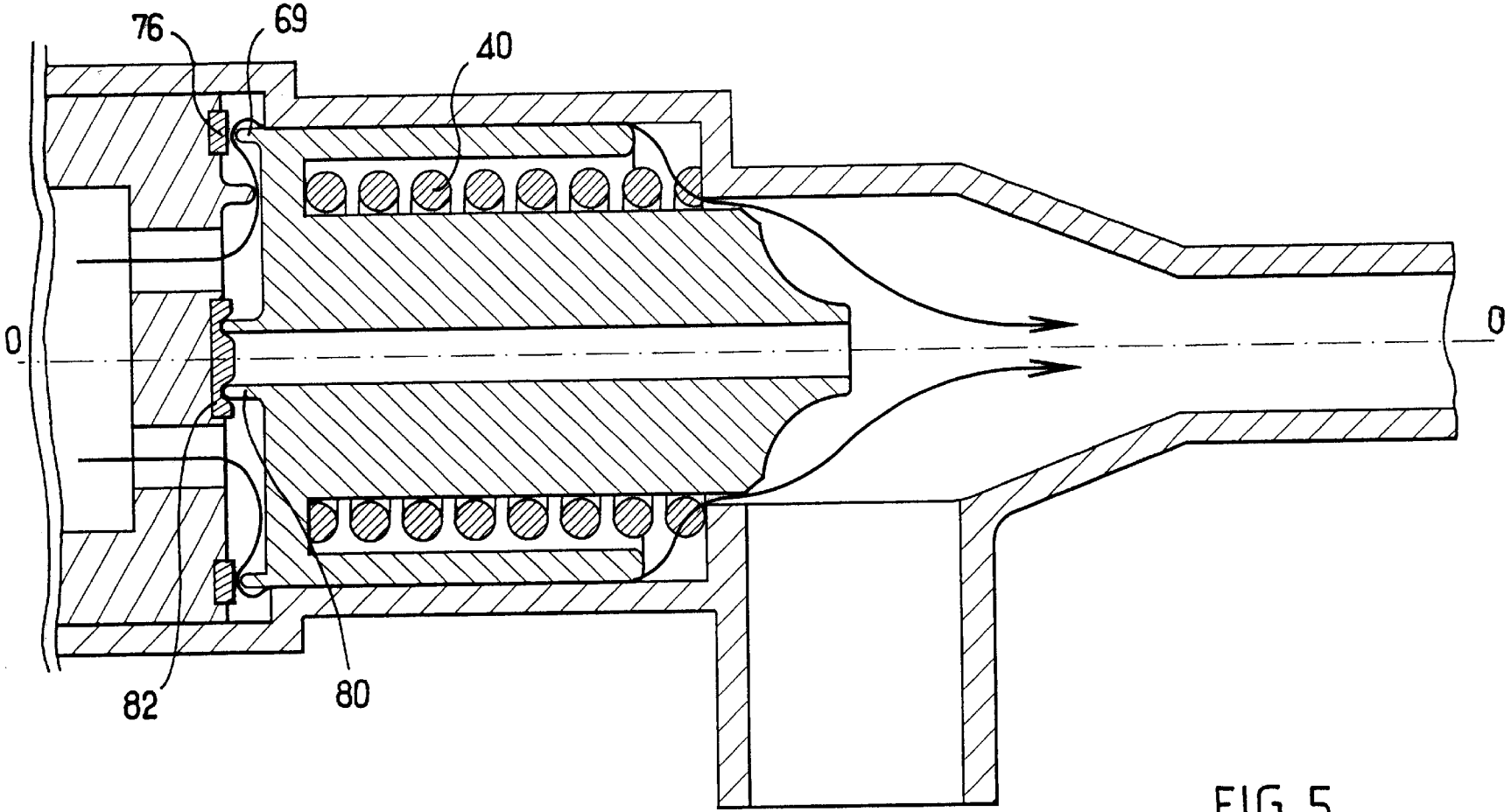
FIG. 5 is a view of the FIG. 4 device with the first sealing element in the open position.

The pressure will eventually reach the first pressure level such that the product of the pressure multiplied by the area of the surface 66 becomes sufficient to overcome the rated force of the spring 40. The moving body 20 is moved in translation towards the downstream end of the device. The first sealing element is opened. This situation is shown in FIG. 5. The fluid can thus flow along the inside walls of the housing 10. However, since the axial extent of the rim 80 is greater than that of the rim 69, the second sealing element remains closed.

Figure 6:
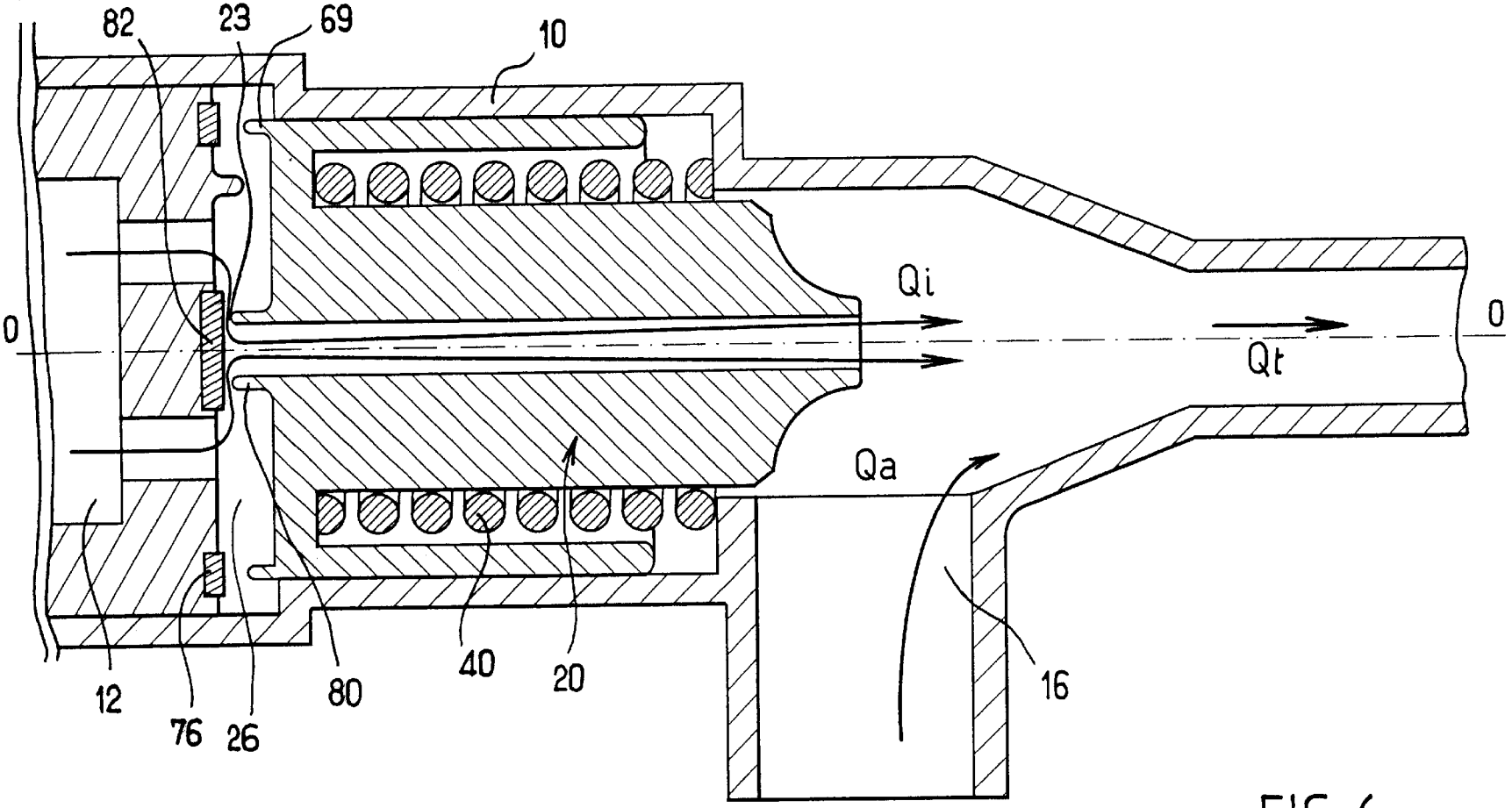
FIG. 6 is a view of the FIG. 4 device with the second sealing element in the open position.

As the pressure continues to increase it reaches a threshold which corresponds to the moving body having moved in translation far enough for the rim 80 to cease to make contact with the gasket 82, thus reaching the situation shown in FIG. 6. The injected fluid can then flow through the inside space of the body 20. Fluid is now sucked in through the inlet 16. The injected flow, the sucked-in flow, and the total outlet flow are represented by arrows Qi, Qa, and Qt respectively.

The self-regulation effect is obtained by the size of the space 23 left between the rim 80 and the gasket 82. The size of the space 23 is a function of equilibrium between the rated force of the spring 40 and the force that results from the product of the pressure of the injected fluid multiplied by the area of the surface 66.

A hysteresis effect can be obtained if the inside wall of the moving body 20 includes a transverse step facing towards the upstream end of the pump. Thus, before the second sealing element opens, the pressure acts on the area of the surface 66, whereas after said element has opened, the pressure of the fluid acts both on the area of the surface 66 plus the area of said step.

Figure 7:
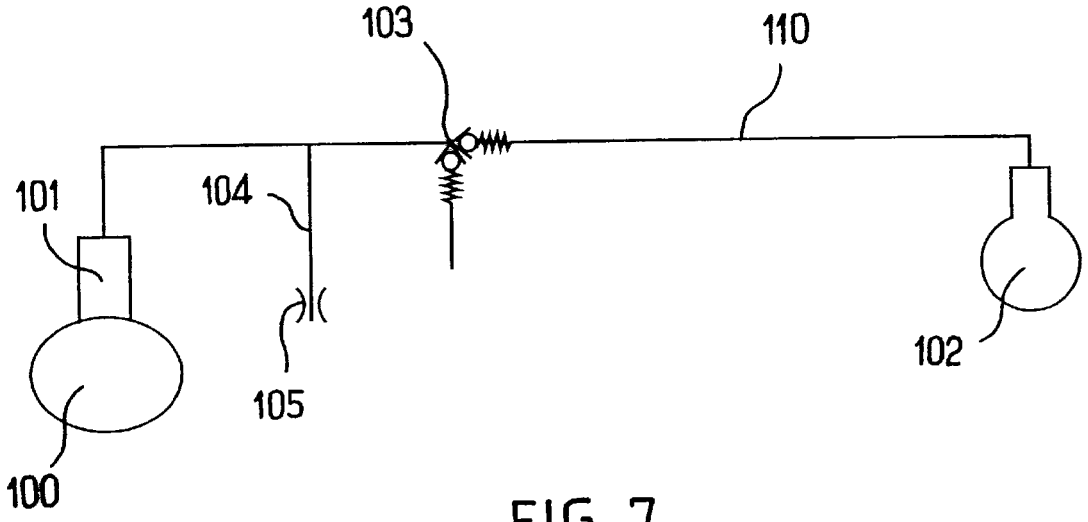
FIG. 7 is a circuit diagram showing how fuel is delivered to an engine from a tank including a prior art jet pump.

FIG. 7 is a circuit diagram for a conventional circuit for feeding fuel from an upstream tank 100 to an engine 102 situated downstream. A pump 101 takes fuel from the tank 100 and injects it into a delivery circuit 110 connecting the tank 100 to the engine 102.

A regulator 103 including a conventional valve enables the circuit 110 downstream from the regulator 103 to be maintained under pressure when fuel is no longer injected into said circuit 110.

A branch connection 104 situated upstream from the regulator 103 and downstream from the pump 101 enables fuel to be delivered to a jet pump 105. In the state of the art, the jet pump 105 is not leaktight when at rest.

The above circuit operates as follows.

When a user starts the engine 102, the pump 101 begins to operate so that the pressure in the circuit 110 reaches its operating level. The assembly comprising the branch connection 104 and the jet pump 105 constitutes a fuel leak from the circuit upstream from the regulator 103, thus decreasing pressure. The pump 101 must therefore always operate faster in order to compensate for the pressure loss. Compensation is particularly unfortunate when the vehicle battery is low.

Figure 8:
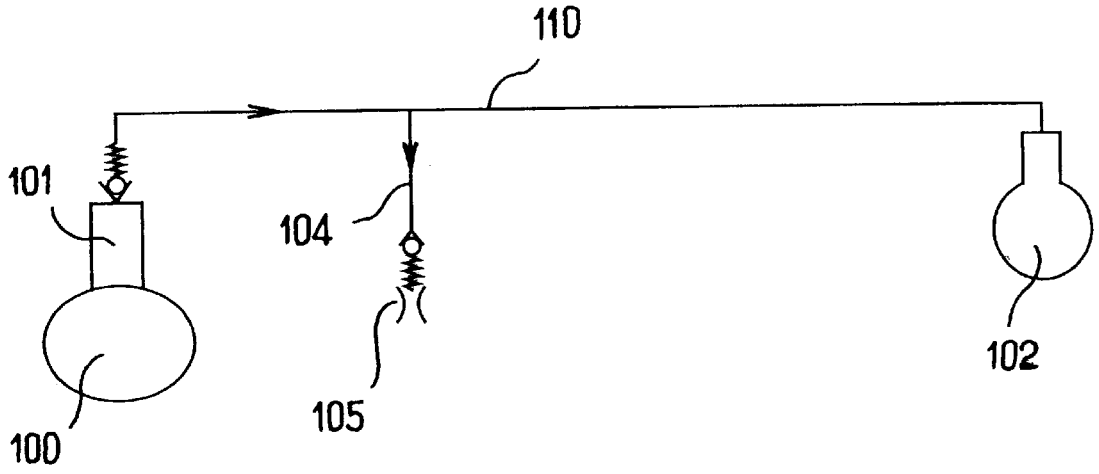
FIG. 8 is a circuit diagram showing how fuel is delivered to an engine from a tank including a jet pump as shown in FIGS. 1 to 6.

FIG. 8 is a diagram of the circuit for delivering fuel from an upstream tank 100 to a downstream engine 102. A pump 101 draws fuel from the tank 100 and injects it into a delivery circuit 110 connecting the tank 100 to the engine 102.

A branch connection 104 situated in the middle of the circuit 110 allows fuel to be diverted to a jet pump 105. The jet pump 105 is one of the embodiments of FIGS. 1 to 6. It has a self-regulating function and it is leaktight when at rest.

At rest, the FIG. 8 circuit does not leak. In contrast, in the FIG. 7 circuit, there is a leak through the jet pump 105.

After the pump has started, the prior art circuit shown in FIG. 7 has two leaks: a first leak through the regulator 103, and a second leak through the jet pump 105.

In the circuit of the invention as shown in FIG. 8, the only leak is through the regulating jet pump 105.

Consequently, the regulating jet pump of FIG. 8 consumes less fuel than the valve jet pump of FIG. 7 associated with a regulator.

The pressure in the circuit 110 therefore rises more quickly.

The opening of the second sealing element avoids too great a peak in the pressure of the injected fluid.

The embodiments described above are fitted in preferred manner with bias springs outside the moving body, however embodiments could also be devised in which a spring for urging the moving body towards the upstream end of the pump is situated inside the nozzle body.

What is claimed is:

1. A jet pump comprising a housing containing a nozzle into which an injected fluid is introduced, the housing also including a suction orifice, the pump comprising, upstream from the outlet of the nozzle, an auxiliary chamber associated with two sealing elements, each sealing element being adapted to open when the pressure of the injected fluid exceeds a predetermined level, the first sealing element opening at a first pressure level, the second sealing element opening at a second pressure level greater than or equal to the first.

2. A pump according to claim 1, wherein the first sealing element is situated upstream from the auxiliary chamber, and the second sealing element situated downstream from the auxiliary chamber.

3. A pump according to claim 1, wherein the first sealing element is situated upstream from the auxiliary chamber, and the second sealing element is also situated upstream from the auxiliary chamber.

4. A pump according to claim 1, wherein the nozzle is slidably mounted in the pump housing to move along a longitudinal axis of the pump housing against bias from a spring that urges the nozzle against a sealing element.

5. A pump according to claim 1, wherein the first sealing element is adapted to open by movement of the nozzle, the second sealing element being adapted to open by limiting the displacement of a second moving element.

6. A pump according to claim 1, wherein both sealing elements are adapted to open by displacement of the nozzle.

7. A pump according to claim 1, wherein the body of the nozzle comprises three portions: a central first portion generally in the form of a hollow circular cylindrical tube of constant cross-section; a second portion integrally molded on an outside surface of the central portion at the upstream end of the first portion and forming a drum extending towards the downstream end of the pump housing over the outside of the central portion; and a third portion situated downstream from the central portion having an outside shape that is substantially frustoconical and that converges downstream, its inside shape forming a nozzle outlet formed by a through axial channel connected to the inside volume of the central portion and opening out into a downstream suction chamber.

8. A pump according to claim 7, wherein a space defined between the drum and the central portion forms a chamber open towards the downstream end of the pump and receiving the spring.

9. A pump according to claim 1, wherein the general outside shape of the body of the nozzle in longitudinal section is substantially W-shaped, the two upstream bends of the W-shape forming a flat bottom defining a surface of generally annular shape lying in a transverse plane, facing upstream, and located inside the housing of the pump.

10. A pump according to claim 9, wherein the annular surface has a longitudinal peripheral rim on its outer periphery extending towards the upstream end of the pump, said rim co-operating with a transverse gasket fixed to the housing of the pump and situated facing the annular surface to define a first sealing element.

11. A pump according to claim 1, wherein the nozzle body is adapted to reciprocate, and wherein the pump has a finger extending inside the inside volume of a central portion of the nozzle body, a cap movable in translation cooperating with a second spring which presses said cap against a transverse shoulder facing towards the upstream end of the pump and formed inside said central portion of the nozzle body, thus forming a second sealing element, the second sealing element is opened when the nozzle body reaches the end of a stroke as the second sealing element follows the displacement of the nozzle body inside the pump housing, said displacement of the nozzle being due to the pressure of the injected fluid acting on the annular surface exceeding the second pressure level.

12. A pump according to claim 9, wherein the central portion and the third portion of the nozzle body both have the same inside diameter, the inside opening of the nozzle body being extended at the upstream end of the nozzle by a circular longitudinally-extending rim integrally molded on the annular surface, said circular rim co-operating with a deformable gasket fixed on an element of the pump so as to form a sealing element, said sealing element opening as the nozzle moves forward, the nozzle being adapted to move forward when the pressure of the injected fluid reaches the second level.

13. A pump according to claim 7, wherein the inside shape of the third portion comprises, in the flow direction of the injected fluid, a first segment of converging frustoconical shape followed by a through second segment of circular cylindrical shape of constant cross-section.

* * * * *